US007097256B2

(12) United States Patent
Tillessen et al.

(10) Patent No.: US 7,097,256 B2
(45) Date of Patent: Aug. 29, 2006

(54) MINING MACHINE WITH RELEASABLE GUIDE PIECE AND THE GUIDE PIECE FOR IT

(75) Inventors: Uwe Tillessen, Kamen (DE); Norbert Hesse, Bochum (DE); Gerhard Siepenkort, Lünen (DE); Klaus Duhnke, Bochum (DE); Adam Klabisch, Dortmund (DE)

(73) Assignee: DBT GmbH, (DE)

( * ) Notice: Subject to any disclaimer, the term of this patent is extended or adjusted under 35 U.S.C. 154(b) by 0 days.

(21) Appl. No.: 11/039,100

(22) Filed: Jan. 20, 2005

(65) Prior Publication Data

US 2005/0161995 A1 Jul. 28, 2005

(30) Foreign Application Priority Data

Jan. 28, 2004 (DE) ..... 20 2004 001 301 U

(51) Int. Cl.
*E21C 35/12* (2006.01)

(52) U.S. Cl. ..... 299/34.07; 299/34.11

(58) Field of Classification Search ..... 299/95, 299/34.07, 34.01, 34.1, 34.11
See application file for complete search history.

(56) References Cited

FOREIGN PATENT DOCUMENTS

DE 37 11 105 A1 10/1988

*Primary Examiner*—John Kreck
(74) *Attorney, Agent, or Firm*—Fay, Sharpe, Fagan, Minnich & McKee, LLP

(57) ABSTRACT

A mining machine for underground mining is disclosed, particularly an extraction or coal plough. When in use, the mining machine is guided along a machine guide, said machine guide including a guide rail and a guide pawl. The guide pawl engaging around said guide rail from above wherein a guide piece is disposed between said guide pawl and said guide rail. The guide piece is releasably attached or attachable to said guide pawl and is sliding along said guide rail. According to the invention, said guide pawl has at least one support means whereassaid guide piece in its installation position is supported on said support means. Further, the guide piece with said guide pawl is fixed by means of a locking mechanism in the longitudinal direction of said guide rail.

17 Claims, 3 Drawing Sheets

Fig.5
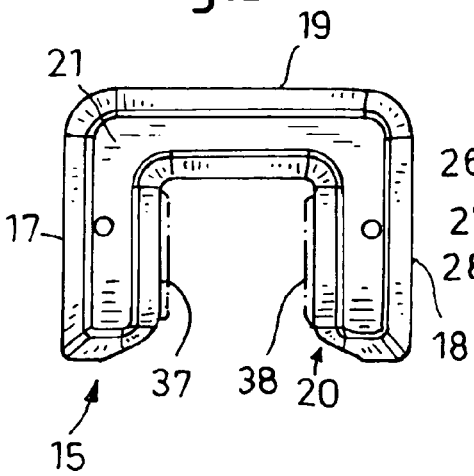
Fig.6
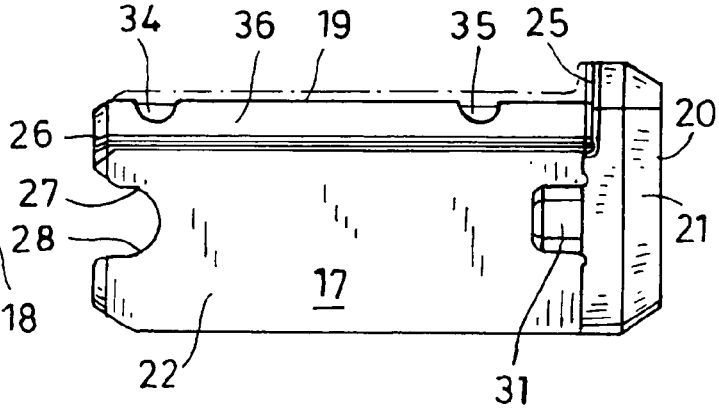
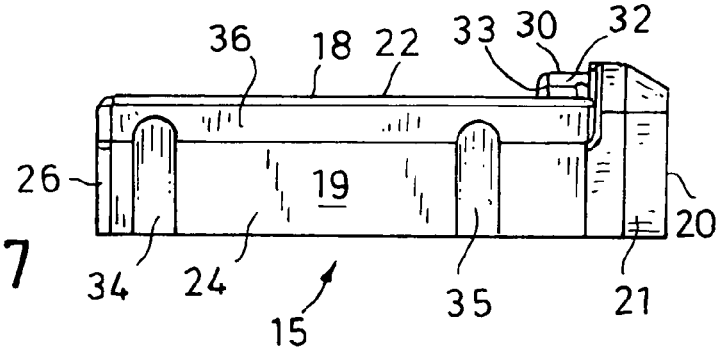
Fig.7
Fig.8
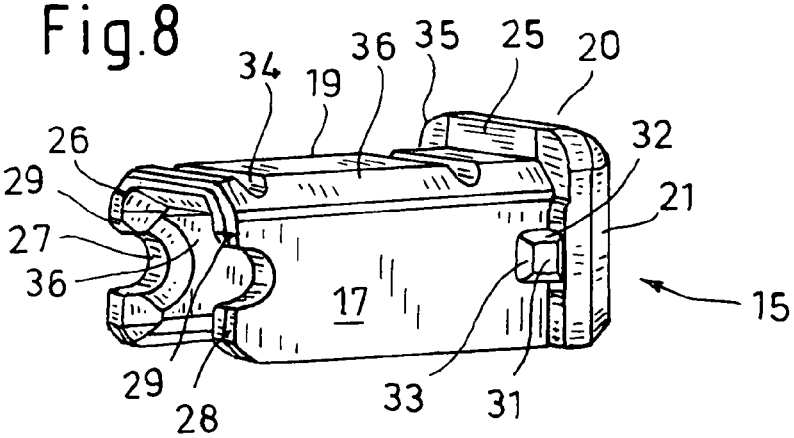

MINING MACHINE WITH RELEASABLE GUIDE PIECE AND THE GUIDE PIECE FOR IT

MINING MACHINE WITH RELEASABLE GUIDE PIECE AND THE GUIDE PIECE FOR IT

The invention relates to a mining machine for underground mining, more specifically to a winning or coal plough, which mining machine is guided along a machine guide that includes a guide rail. The invention also relates to a guide piece that slides on or along the guide rail.

A generic mining machine, configured as an extraction plough, is known from DE 37 11 105 A1. The plough described therein has an upper guide pawl that engages the guide rail from above. A guide piece, provided between the guide pawl of the plough and the guide rail, is attached to the guide pawl and slides on or against the fixed guide rail when the plough is being operated. Since the guide piece is exposed to extreme strain it is subjected to a high rate of wear. It is therefore detachably attached to the guide pawl so that it can be exchanged regularly. The U-shaped guide piece is configured with two limbs, set apart from one another. The guide piece on one base and on a transverse web that connects the limbs thereof is provided with bores through which bolts engage via which the exchangeable guide piece can be attached to the guide pawl of the plough body. If, in the course of an exchange, a new guide piece is to be attached to the guide pawl, the guide piece must be held in a corresponding position until the joint with the guide pawl has been effected. Only then does the guide pawl hold the weight of the guide piece via the bolts.

In the practice of underground mining, the exchange of the guide piece with the bolts guided through its base has proven to be awkward and requires a great deal of effort. Therefore the purpose of the invention is to provide a mining machine of the type mentioned above in which replacement of the guide piece is easier to achieve.

SUMMARY OF THE INVENTION

This object according to the invention is achieved in that the guide pawl that serves to receive the exchangeable guide piece has, or forms, at least one support on or against which the guide piece can support itself, and that a locking mechanism is provided with which the guide piece is fixed in its installation position against the guide pawl in the longitudinal direction of the guide rail, i.e. parallel to the direction of movement of the plough.

With the mining machine according to the invention, the weight of the guide piece is no longer held on the guide pawl by a bolt connection that is to be established, but rather by said support or more specifically by a plurality of positive locking supports. The support or the plurality of supports, and the guide piece they support, are preferably made so that the guide piece can be pushed or moved parallel to the direction of movement of the mining machine into a corresponding mounting at the guide pawl, wherein the guide piece then comes into positive locking contact with the projections on the guide pawl that form the support. The guide piece, the weight of which is now held by the positive or form-locking connection, is only fixed by the locking mechanism transverse to the positive direction of the weight, especially in the longitudinal direction of the guide piece or in the longitudinal direction of the guide rail.

For downward support, the guide piece can additionally have at least one lug to create or effect a further support, which lug engages in a correspondingly formed recess on the guide pawl, especially an open-rim recess. It is also possible for the guide pawl to have a lug or a projection that co acts with a corresponding recess on the guide piece. Lugs, projections and/or corresponding recesses, for example groove-shaped recesses, can also extend over the entire length of the guide piece, wherein the guide piece advantageously can be pushed into the holding fixture of the guide pawl like a drawer and can be supported therein. In the preferred embodiment, a support is provided on the guide pawl at both respective sides of the guide piece.

In a preferred embodiment, a bolt can be provided as a locking mechanism that engages through at least one bore in the side walls of the guide pawl and against which the guide piece abuts in the lateral direction or in the longitudinal direction of the guide rail. A securing device can be provided to ensure that the bolt does not release itself from its locking position. For example, the bolt can be provided with a thread at one end to receive a nut.

In its position of use, the guide piece, according to the invention, for a mining machine with the aforementioned features engages around the guide rail from above and is configured in a U-shape with two limbs that are at a distance from one another. It characterises in that projections and/or recesses are provided on the outer sides of the limbs, with which the guide piece can support itself with positive (form-) locking on the guide pawl in the vertical direction.

In a preferred embodiment, an edge is formed on the first front end that projects with regard to the outer sides of the limbs and with regard to an outer side of a transverse web that connects the limbs. From this projection, a rear side of the edge results that serves as an abutment of the guide piece on a front surface of the guide pawl. It is also preferred that a projection or lug is formed on the respective outer sides of the limbs which projection or lug extends from the edge in the longitudinal direction of the guide piece. It is also preferred that on a second front end of the guide piece a recess is provided on one limb each which recess is preferably open in the direction of the second front end. The recess is preferably disposed on the outer side of a limb but it can also involve the entire wall thickness of the limb. It is preferred that the recess is defined as a semi-circle. In order to facilitate the insertion of a round lug or the like into the recess, wherein the lug and the recess engage with positive locking, the front-side opening of the recess can be opened out further by means of a chamfer or an inclination. The inclination can be disposed at an upper end of the recess so that it slightly lifts the guide piece when it abuts the lug on insertion into the holding fixture of the guide pawl.

It is also preferred that at least one groove, extending from limb to limb, is formed on the outer side of the transverse web that connects the two opposed limbs. Preferably, the groove can be semi-circular in cross-section and, at least in part, can receive a bolt or the like in its longitudinal direction. If the guide piece is fixed in its position of use both in the upward direction by the abutment of the guide pawl that engages around the guide piece from above and that is open to the bottom, and in the downward direction by the holding fixture of the guide pawl, the guide piece can be locked in the lateral direction, that is, in the direction of movement of the extraction machine, by the bolt that engages in the groove and is rigidly connected to the guide pawl.

The guide piece preferably forms a wearing part that is easy to replace. To this end, an area with increased resistance to wear or a wearing plate can especially be provided on an inner side of at least one limb. The increased resistance to wear can especially be attained by inductive hardening. It is also possible to provide recesses on the inner sides to receive wear inlays, preferably made of hard metal.

BRIEF DESCRIPTION OF THE DRAWINGS

The invention will now be explained in greater detail with reference to an example shown in the drawings. It shows:

FIG. 5 an individual view of the guide piece of the plough according to FIG. 1 in an increased scale;

FIG. 6 a side elevation of the guide piece;

FIG. 7 a top view of the guide piece; and

FIG. 8 a perspective view of the guide piece.

DETAILED DESCRIPTION OF PREFERRED EMBODIMENTS

Figure 1:
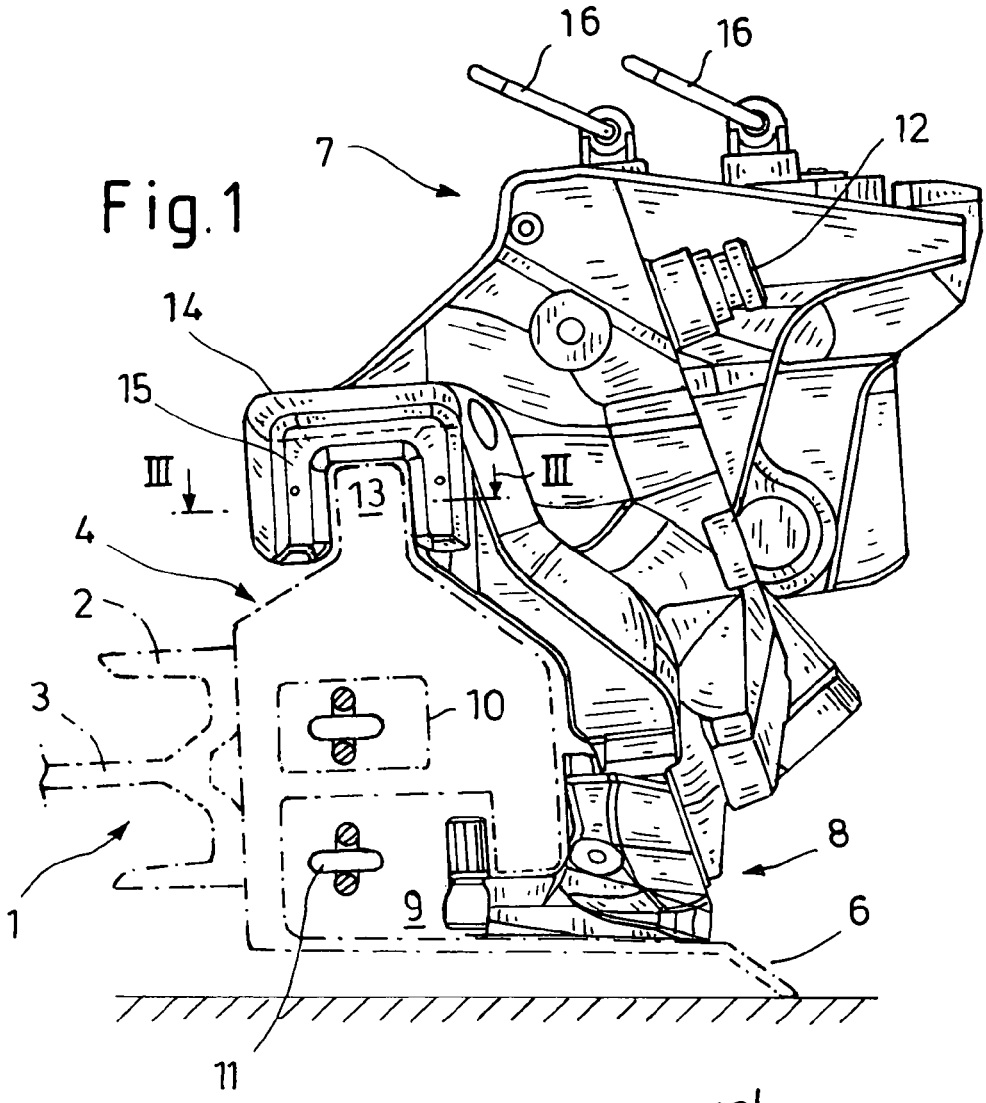
FIG. 1 a schematic view of a section of a plough guide with a plough including a guide piece guided along the plough guide.

FIG. 1 indicates a face conveyor 1 laid out before a coal head (not illustrated), of which conveyor only a face cutting-side profile 2 and a conveyor base 3 are shown. A plough guide 4 is attached to the side profile 2 of the face conveyor 1 on the face-cutting side, here shown schematically only in outline. The plough guide 4, like a track of conveyor pans of the face conveyor, comprises individual sections that can be angled slightly with respect to each other in the horizontal and vertical plane.

The plough guide 4 comprises a rail 6 angled at an acute angle to the floor 5, on which a plough 7 is supported on its two front-side ends by means of a sliding runner 8 each, of which only one sliding runner 8 is shown in FIG. 1. Above the rail 6, the plough guide has a lower chain channel 9 and an upper chain channel 10, through which the runs of an endless plough chain 11 extend to drive the plough 7 along the plough guide 4. A bearing journal 12 is formed on the plough body of the plough 7 for a pivotable mounting of a cutting bar, not illustrated, on which tools are disposed to dislodge, for example, coal.

The plough guide 4 has an upwardly-directed guide rail 13 at its apex. An upper guide pawl 14 engages over the guide rail 13 at both face-side ends of the plough 7 like a hook. Between the guide pawl 14 and the guide rail 13 a U-shaped guide piece 15 is provided that can be detached from the guide pawl and replaced because it is exposed to increased wear and is therefore a wearing item. Here, the guide piece 15 sits in a similarly U-shaped holding fixture of the guide pawl 14 that is open to the bottom. Crane eyelets 16 are disposed on an upper side of the plough 7, with which the plough 7 can be lifted with suitable lifting means.

Figure 2:
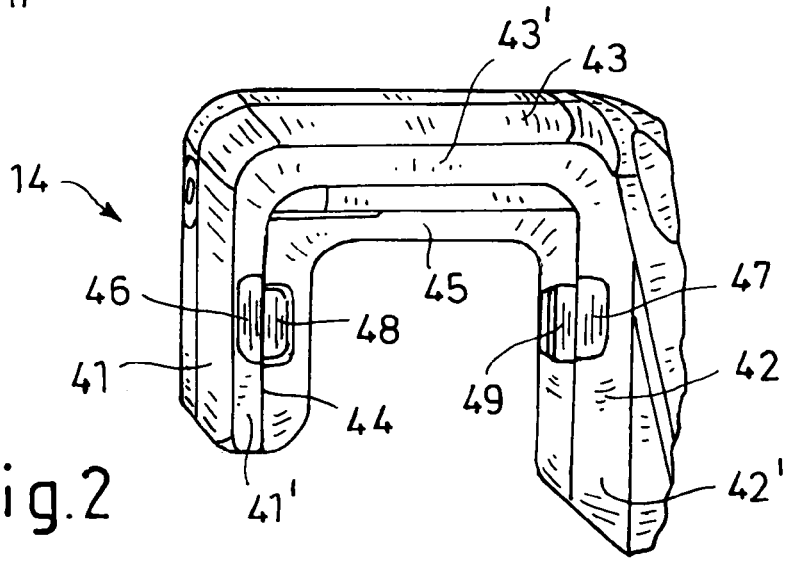
FIG. 2 a front elevation of the guide pawl of the plough according to FIG. 1 without the guide piece.

FIG. 2 shows a front view of one the guide pawls 14 of the plough with the guide piece removed. The holding fixture 40 of the guide pawl that is open to the bottom and to the rear is limited by two lateral side walls 41, 42 and an upper wall 43 that connects these. The three walls 41, 42, 43 being arranged in a U-form are provided with a continuous step 44 on their inner sides so that the walls 41, 42, 43 form a U-shaped rear stop face 45 for the guide piece within the holding fixture, whilst the face sides 41', 42' and 43' of the walls 41, 42, 43 form a front stop for the guide piece.

Figure 3:
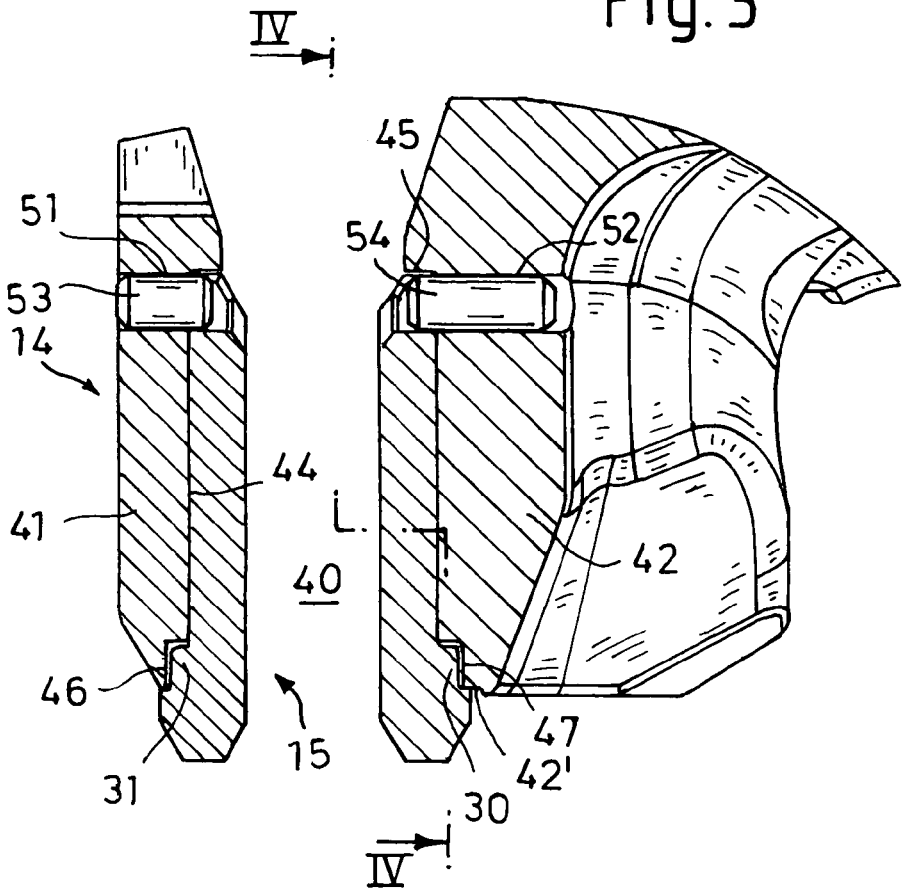
FIG. 3 a sectional view along line III—III in FIG. 1.
Figure 4:
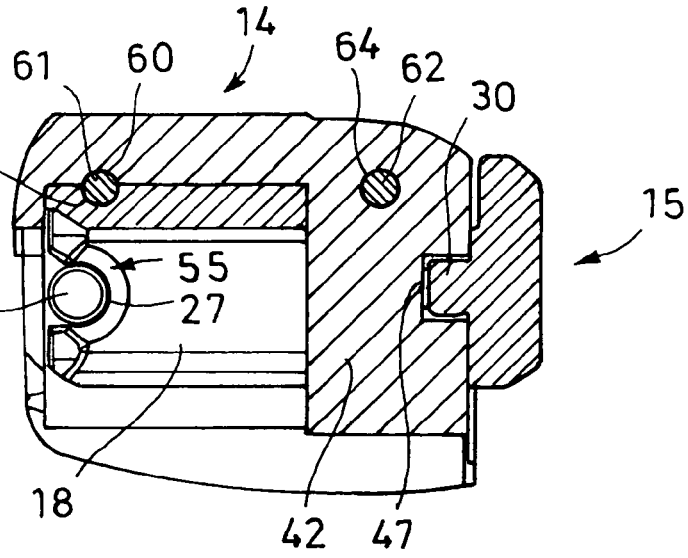
FIG. 4 a sectional view along the line IV—IV in FIG. 3.

FIG. 3 and FIG. 4 show, by means of a horizontal longitudinal section, the installation position of the guide piece 15 in the guide pawl 14. It can easily be seen that the rear stop face 45 is disposed at the rear end of the holding fixture 40. It can also be seen from FIG. 2 and FIG. 3 that on the one hand, a rectangular recess 46, 47 is formed in the face side 41', 42' of both side walls 41, 42 which recesses are open to the inner sides and that on the other hand, two lug stumps 48, 49 project over the inner sides of the side walls 41, 42 directly before the stop wall 47 which lug stumps particularly can be formed by the ends of two bolt lugs 53, 54 immovably mounted in transverse bores 51, 52 in the side walls 41, 42. The projecting ends of the bolt lugs 53, 54, configured as lug stumps 48, 49, form a first support, designated in its entirety with 55, on which the guide piece 15 is supported in a positive form-locking manner against the guide pawl 14 in its installation position, and the recesses 46, 47 in the front sides 41', 42' form a second support, designated in its entirety with 56, for the guide piece 15 against the guide pawl 14, as will be explained below.

Firstly, the structure of the guide piece 15, shown in detail in FIGS. 5 to 8, will now be explained. Here, FIG. 5 shows an enlarged detail view of the guide piece 15 that is recognisable in front elevation in FIG. 1. FIG. 6 shows the guide piece from the side, whilst FIG. 7 shows a top view of one half of the guide piece 15. Two limbs 17, 18 of the guide piece 15, set apart from one another, are connected by a perpendicularly-set base or transverse web 19. The guide piece 15 has an edge 21 on a first front end 20 that projects with regard to the outwardly-directed sides (outer sides 22, 23) of the limbs 17, 18 and over the outer side 24 of the transverse web 19. A rear side 25 of the edge 21 results from this projection that faces away from the first front side of the guide piece 15 and in the installation position of the guide piece 15 abuts on the front side (43', FIG. 2) of the upper wall (43, FIG. 2) of the guide pawl (14, FIG. 2). The corners of the edge 21 are rounded and their edges are chamfered.

On a second front end 26 the guide piece 15 has semi-circular recesses 27, 28 that are open to the front side 26 on its limbs 17, 18, into which, in the installation position of the guide piece 15, as especially shown in FIG. 2 to FIG. 4, the lug-shaped stumps 48 and 49, that are round in cross-section and that project into the holding fixture 40 within the guide pawl 14, engage in a positive form-locking manner to provide the first support 55 for the guide piece 15. The guide piece 15 is therefore supported in a positive locking manner by these stumps in the downward direction on the second front end 26. Both recesses 27, 28 have a rounded portion 29 on their upper, front-side end that facilitates engagement of the lug stumps (49, FIG. 4) in the recesses 27, 28 when the guide piece 15 is inserted into the holding fixture (40, FIG. 4) of the guide pawl.

Furthermore, in each case a lug-like projection 30, 31 is formed onto the two outer sides 22, 23 of the guide piece 15, extending in the direction of the second front end 26. The projection 30, 31 has a cross-section that is basically rectangular. Both, the longitudinal edges 32 that extend in the longitudinal direction and the front edges 33 that extend perpendicular thereto of the projection 30, 31, are chamfered. The chamfered edges 32, 33 of the projections 30, 31 and the rounded portions 29 of the recesses 27, 28 facilitate their engagement in the associated, open-rim recesses (46, 47, FIG. 2), that are formed within the holding fixture of the guide pawl in a corresponding position, as explained above. In this way, the guide piece 15 is also supported, positive locking, on the second front end 20 by the guide pawl in the downward direction, therefore in the vertical direction, on both sides by a further support (56, FIG. 4), wherein the guide piece 15 is held in position without detachable attachment means. It can easily be seen from FIG. 4 that in each case a lug stump 49 on the guide pawl 14 forms a first support 55 with the associated recess 27 in the guide piece 15 and in each case a projection 30 on the guide piece 15 forms a further support 56 with the associated recess 47 in the guide pawl 14, wherein the guide piece 15 supports itself on both sides of the guide pawl 14 on this total of four supports 55, 56.

As can especially be seen in FIG. 6 and FIG. 7, two semicircular grooves 34, 35 extend between the limbs 17, 18 on the outside 24 of the transverse web 19. The grooves extend perpendicular to the longitudinal direction of the guide piece 15 and therefore also, in the installation position of the guide piece, perpendicular to the guide rail (13, FIG. 1). The groove 34 is set adjacent to the first front end, whilst the groove 35 is formed adjacent to the second front end. As can especially be seen from FIG. 4, the grooves 34 and 35 together with correspondingly-configured grooves 60 open in the downward direction, in the side walls of the guide pawl 14, each form a channel with a round cross-section that serves for insertion of a locking bolt 61 or 62. Since the bolts 61, 62 on both sides of the guide piece penetrate closed-rim bores 64 in the side walls 42 of the guide pawl 14, at least at their ends, the position of the guide piece 15 in the holding fixture 40 of the guide pawl 14 is fixed by the bolts 61, 62 as a locking mechanism.

FIG. 8 shows the guide piece in a perspective view. Even the longitudinal edges 36, on which the outer sides 22, 23 of the limbs 17, 18 abut on the outer side 24 of the transverse web 19 are chamfered, wherein the guide piece 15 has no projecting edges that could be easily damaged. The inner sides 37, 38 of the limbs 17, 18 are inductively hardened to obtain a hardened, wear-resistant surface at those points where the guide piece comes into contact with the guide rail 13. Preferably, the hardened surface exceeds a hardness of 52 HRC.

The invention claimed is:

1. A mining machine for underground mining, particularly an extraction or coal plough, said mining machine when in use being guided along a machine guide, said machine guide including a guide rail and a guide pawl, said guide pawl engaging around said guide rail from above, wherein a guide piece is disposed between said guide pawl and said guide rail, said guide piece being releasably attached or attachable to said guide pawl and sliding along said guide rail, wherein said guide pawl comprises at least one support means, said guide piece in its installation position being supported on said support means, whereas said guide piece with said guide pawl is fixed by means of a locking mechanism in the longitudinal direction of said guide rail.

2. A mining machine according to claim 1, wherein said guide piece comprises at least one projection, said projection engaging with a corresponding, preferably open-rim recess in said guide pawl to effect said support.

3. A mining machine according to claim 1 wherein said guide piece comprises at least one recess, said recess co-acting with a projection, said projection being formed, preferably in the form of a lug stump, on said guide pawl, said co-acting effecting a support.

4. A mining machine according to claim 1 wherein said guide piece is supported on both sides by at least one support.

5. A mining machine according to claim 1 wherein at least one bolt is provided as said locking mechanism, said bolt engaging through at least one bore in said guide pawl, said guide piece abutting on said bolt in the longitudinal direction of said guide rail.

6. A mining machine according to claim 5, wherein said bolt is provided with a securing device to prevent unintentional release.

7. A guide piece for a mining machine, said guide piece engaging around a guide rail of a machine guide when said mining machine is in operation, said guide piece being U-shaped with two limbs being arranged at a distance from one another, wherein projections and/or recesses are provided on outer sides of said limbs which extend in the longitudinal direction of the guide piece and which form part of a longitudinally extending locking mechanism with which said guide piece is supportable or supported on a guide pawl formed on said mining machine.

8. A guide piece according to claim 7, wherein an edge is formed on a first front end of said guide piece, said edge projecting over respective outer sides of said limbs and over an outer side of a transverse web that connects said limbs and forming an abutment for the guide piece in the installation position.

9. A guide piece according to claim 7, wherein, a projection or a lug is formed on said outer sides of said limbs, said projection or lug extending from said edge in the longitudinal direction of said guide piece.

10. A guide piece according to claim 7, wherein on a second front end, a recess is provided in each of said limbs.

11. A guide piece according to claim 10, wherein recess is semi-circular.

12. A guide piece according to claim 10, wherein said recess has an opening directed towards said second front side whereas preferably said opening is opened out by means of a chamfer or an inclination.

13. A guide piece according to claim 8, wherein at least one groove extending transversely from said one limb to said other limb is formed on said outer side of said transverse web.

14. A guide piece according to claim 13, wherein said profile of said groove is semi-circular.

15. A guide piece according to claim 7, wherein a wear covering or an area of higher resistance to wear is provided on an inner side of each of said limbs.

16. A mining machine guide piece comprising:

a U-shaped structure defined by first and second spaced-apart longitudinally extending limbs connected by a transverse web;

a locking mechanism for mounting said guide piece to an associated guide pawl of an associated mining machine, said locking mechanism comprising at least one of a longitudinally extending recess defined in or a longitudinally extending projection extending outwardly from each of said first and second spaced-apart limbs, wherein said locking mechanism is adapted to releasably engage a corresponding mating structure of the associated guide pawl when said guide piece is mated with the associated guide pawl via longitudinal sliding movement of the guide piece relative to the associated guide pawl.

17. The guide piece as set forth in claim 16, further comprising an edge is formed on a first front end of said guide piece, said edge projecting outward relative to respective outer sides of said first and second limbs and said transverse web, said projecting edge defining an abutment adapted to abut the associated guide pawl when said guide piece is slidably mated with the associated guide pawl via said locking mechanism.

* * * * *